US011753902B2

(12) United States Patent
Docherty et al.

(10) Patent No.: US 11,753,902 B2
(45) Date of Patent: Sep. 12, 2023

(54) DOWNHOLE APPARATUS

(71) Applicant: Weatherford U.K. Limited, Loughborough (GB)

(72) Inventors: Derrick Docherty, Loughborough (GB); Stephen Reid, Loughborough (GB)

(73) Assignee: Weatherford U.K. Limited, Leicestershire (GB)

( * ) Notice: Subject to any disclaimer, the term of this patent is extended or adjusted under 35 U.S.C. 154(b) by 0 days.

(21) Appl. No.: 16/965,550

(22) PCT Filed: Feb. 15, 2019

(86) PCT No.: PCT/GB2019/050400
§ 371 (c)(1),
(2) Date: Jul. 28, 2020

(87) PCT Pub. No.: WO2019/162651
PCT Pub. Date: Aug. 29, 2019

(65) Prior Publication Data

US 2021/0047899 A1 Feb. 18, 2021

(30) Foreign Application Priority Data

Feb. 21, 2018 (GB) ..... 1802821

(51) Int. Cl.
*E21B 34/08* (2006.01)
*E21B 34/10* (2006.01)
(Continued)

(52) U.S. Cl.
CPC ..... *E21B 34/08* (2013.01); *E21B 23/04* (2013.01); *E21B 23/06* (2013.01); *E21B 34/102* (2013.01); *E21B 34/14* (2013.01); *E21B 2200/06* (2020.05)

(58) Field of Classification Search
CPC .... E21B 34/08; E21B 34/102; E21B 2200/06; E21B 2200/04; E21B 34/14; E21B 23/04; E21B 23/06; E21B 34/06
See application file for complete search history.

(56) References Cited

U.S. PATENT DOCUMENTS 3,414,058 A * 12/1968 De Rochemont ..... E21B 33/122 166/134
5,417,288 A 5/1995 Melenyzer et al.
(Continued)

FOREIGN PATENT DOCUMENTS

RU 2010123766 A 12/2011
RU 2615530 C1 4/2017
(Continued)

OTHER PUBLICATIONS

UK Search Report received in copending UK Application No. GB1802821.7 dated Jul. 19, 2018, 7 pages.
(Continued)

*Primary Examiner* — Nicole Coy
(74) *Attorney, Agent, or Firm* — Cabello Hall Zinda, PLLC

(57) ABSTRACT

Downhole apparatus is provided for location in a fluid-filled bore, such as a well bore. The apparatus comprises a tubular body comprising a plurality of cylindrical chambers for containing a compressible substance, and pistons mounted in the chambers. A lock arrangement is provided and has a locking configuration for retaining the pistons in the chambers and an unlocked configuration in which bore fluid pressure may translate the pistons through the chambers.

19 Claims, 7 Drawing Sheets

(51) Int. Cl.

| | |
|---|---|
| ***E21B 34/14*** | (2006.01) |
| ***E21B 23/04*** | (2006.01) |
| ***E21B 23/06*** | (2006.01) |

(56) References Cited

U.S. PATENT DOCUMENTS

| | | | | |
|---|---|---|---|---|
| 5,819,854 | A | 10/1998 | Doane et al. | |
| 8,261,835 | B2 | 9/2012 | Plunkett et al. | |
| 8,991,489 | B2 * | 3/2015 | Redlinger | E21B 31/12 166/242.6 |
| 10,920,525 | B2 * | 2/2021 | Tveranger | E21B 34/14 |
| 2005/0205269 | A1 | 9/2005 | Kilgore et al. | |
| 2008/0236844 | A1 | 10/2008 | Gaudette et al. | |
| 2016/0130897 | A1 | 5/2016 | Machocki | |
| 2018/0223629 | A1 * | 8/2018 | Reid | E21B 34/102 |

FOREIGN PATENT DOCUMENTS

| | | | |
|---|---|---|---|
| WO | 99/27224 | A1 | 6/1999 |
| WO | 2014/123540 | A1 | 8/2014 |
| WO | 2014/193405 | A1 | 12/2014 |
| WO | 2017/204657 | A1 | 11/2017 |

OTHER PUBLICATIONS

PCT Search Report received in copending PCT Application No. PCT/GB2019/050400 dated Aug. 29, 2019, 10 pages.
Search Report in counterpart Russian Appl. No. 2020130834, dated Dec. 1, 2021.

* cited by examiner

DOWNHOLE APPARATUS

FIELD

This disclosure relates to downhole apparatus. Aspects of the disclosure relate to pressure actuated apparatus.

BACKGROUND

In oil and gas exploration and production, hydrocarbon-bearing formations may be accessed by drilling bores from surface to form wells. The bores tend to be filled with liquid, which may be, for example, brine, drilling fluid or drilling "mud". In shallower wells the hydrostatic pressure of the fluid in the well may be utilized to translate a downhole sleeve provided in an apparatus. For example, a downhole tool to be incorporated in a tubing string may include a large atmospheric chamber closed at one end by an annular piston. If the opposite face of the piston is exposed to tubing or annulus pressure, the piston will move through the chamber, compressing the air in the chamber, and the movement of the piston may be utilized to stroke a sleeve.

In other examples a sleeve may be moved by running an intervention tool into the bore to engage the sleeve. Alternatively, hydraulic fluid may be utilized to move a sleeve, the hydraulic fluid being supplied by a downhole pump or from surface via control lines.

SUMMARY

According to an example of the present disclosure there is provided downhole apparatus for location in a fluid-filled bore, the apparatus comprising a tubular body comprising a plurality of cylindrical chambers for containing a compressible substance, pistons mounted in the chambers, and a lock arrangement having a locking configuration for retaining the pistons in the chambers and an unlocked configuration in which bore fluid pressure may translate the pistons through the chambers.

According to another example of the present disclosure there is provided a downhole method comprising: providing a tubular tool body including pistons located in cylindrical chambers containing a compressible substance; running the tool body into a fluid-containing bore such that ambient pressure increases; and translating the pistons through the chambers under the influence of the increased ambient pressure.

The provision of a plurality of cylindrical chambers in the body facilitates provision of chambers which will withstand elevated hydrostatic pressures. In oil and gas wells, bores drilled to access hydrocarbon-bearing formations may extend thousands of meters below the surface of the earth, and may be drilled in the seabed, itself sometimes hundreds of meters below sea level. As a result, the fluid in the wells may be at very high hydrostatic pressures. A conventional annular atmospheric chamber in the body of a downhole tool experiences burst pressure from within the tool body and collapse pressure from outside of the tool body. For a tool intended for use in deep wells it would not normally be possible to accommodate the chamber wall thicknesses required to withstand such burst and collapse pressures.

The lock arrangement may take any appropriate configuration. For example, the lock arrangement may initially restrain the pistons relative to the body. The lock arrangement may include a key, dog or other coupling which initially restricts movement between the pistons and the body and the coupling may be moved, reconfigured or released to permit such movement. The lock arrangement may include a lock member which is translatable to release or permit movement of the pistons, and translation of the lock member may allow movement or release of a key, dog or the like. For example, the lock member may be axially translatable to release the pistons. The translation of the lock member may be achieved by any appropriate arrangement, and may be in response to ambient pressure. The lock member may comprise a balance piston. Translation of the lock member may require displacement of a control fluid, which fluid may be substantially incompressible, such that initially trapping the control fluid, or at least restricting displacement of the fluid, restricts movement of the lock member. A valve arrangement may be provided to control flow of the fluid, and thus control movement of the lock member. The valve arrangement may be operable to permit flow of the control fluid into a lower pressure volume, for example an atmospheric chamber. The valve arrangement may be provided in combination with an appropriate control or actuation arrangement, such as a solenoid or a fuse. In one example the fuse may feature or control a valve element, such as a valve member retainer or valve closure, of a fusible material such as para-aramid synthetic fiber, such as sold under the KEVLAR®, which is wrapped or otherwise coupled with a heating element, for example a resistive material, such as nickel chromium wire. (KEVLAR is a trademark of DUPONT SAFETY & CONSTRUCTION, INC.) In one example a valve member is biased towards an open position but is retained in a closed position by a heat-sensitive retainer, such as a KEVLAR cord. When current from a battery is permitted to flow through and heat the wire, the KEVLAR material melts, fails or otherwise degrades and the valve arrangement opens to permit displacement of the control fluid. A switch controlling current flow from the battery may close in response to signals transmitted from surface, for example a sequence of pressure pulses or via RFID tags. In other examples the valve arrangement may include a solenoid or other valve member actuating arrangement.

The pistons may be operatively associated with a common sleeve or other member, such that translation of the pistons results in translation of the sleeve or other member. The translation of the pistons may result in operation or activation of a tool or device, for example opening or closing a valve, changing the configuration of a valve, activating or actuating a tool, setting or retracting slips, or setting a packer. The pistons may be coupled to a common sleeve or member in a manner that permits movement of the sleeve or member without requiring movement of all of the pistons. Thus, if one or more pistons is inoperative, the operative pistons may still translate the sleeve. The pistons may decouple from the tool or device following activation of the apparatus, for example to permit subsequent manual operation of the tool or device.

The plurality of cylindrical chambers may be provided by a plurality of tubes located within or on a wall of the body, or may be formed in a common housing, for example as gun-drilled bores in a cylindrical tool wall portion.

The body may be generally cylindrical and may be adapted for location in a tubing string, for example a drill string, casing or liner, running string, tool string or a completion. The body may be configured to form part of a tubing string.

The chambers may extend axially of the body, and may extend parallel to a main axis of the body.

The chambers may be circumferential spaced and may be equally spaced around a selected pitch circle diameter (PCD). Alternatively, the chambers may not be equally spaced and may not lie on a PCD. For example, the tool body may have offset inner and outer diameters such that a portion of the body wall is relatively thick, and the chambers may be provided in the thicker wall portion.

The chambers may be axially spaced, and one or more chambers may be axially aligned.

The compressible substance may be a fluid, that is a gas or a liquid. The compressible substance may be air, or another gas, for example Nitrogen. The chambers may initially contain fluid at or close to atmospheric pressure. For example, the apparatus may be assembled on surface and the chambers occupied by ambient air. However, the chambers may also be initially evacuated, to provide a vacuum or partial vacuum, or may be pressurized, that is filled with fluid at above atmospheric pressure.

Two or more chambers and pistons may be provided. Any appropriate number of chambers and pistons may be provided, for example twelve chambers and pistons may be provided. The number of chambers and pistons may be odd, such as three, five, seven, nine, eleven or more; or even, such as four, six, eight, ten, twelve or more. Depending on the force required to be provided by the pistons, and the ambient pressure available in the well to translate the pistons, it may not be necessary to utilize all of the available chambers and pistons. Also, the number of chambers and pistons utilized may be selected to provide some redundancy, for example to accommodate a seal failure in one of the pistons.

One or more of the chambers may be configured to dampen the movement of the other pistons. For example, one or more chamber may be configured to permit ingress of ambient fluid as the apparatus is run into the bore or may be initially filled with material, for example hydraulic oil. The movement of the damping pistons may be linked to the other pistons. As the other pistons are moved through the chambers under the influence of the increased ambient pressure the damping piston must displace the ambient fluid or hydraulic oil from the damping chamber.

In other examples the chambers may be configured differently, for example a plurality of annular chambers with associated annular pistons may be provided. By providing a plurality of cooperating annular pistons it is possible to provide a significant actuation force while minimizing the wall thickness of the pistons. Thus, the associated chambers may be accommodated more readily within the thickness of the tool body and the inner and outer walls of the chambers may be relatively thick, to accommodate elevated hydrostatic pressures.

It will be apparent to the skilled person that the various features described above may have utility both individually and in combination, and further that these features may be provided in combination with any of the features recited in the claims below.

BRIEF DESCRIPTION OF THE DRAWINGS

These and other aspects of the disclosure will now be described, by way of example only, with reference to the accompanying drawings, in which.

DETAILED DESCRIPTION OF THE DRAWINGS

Figure 1:
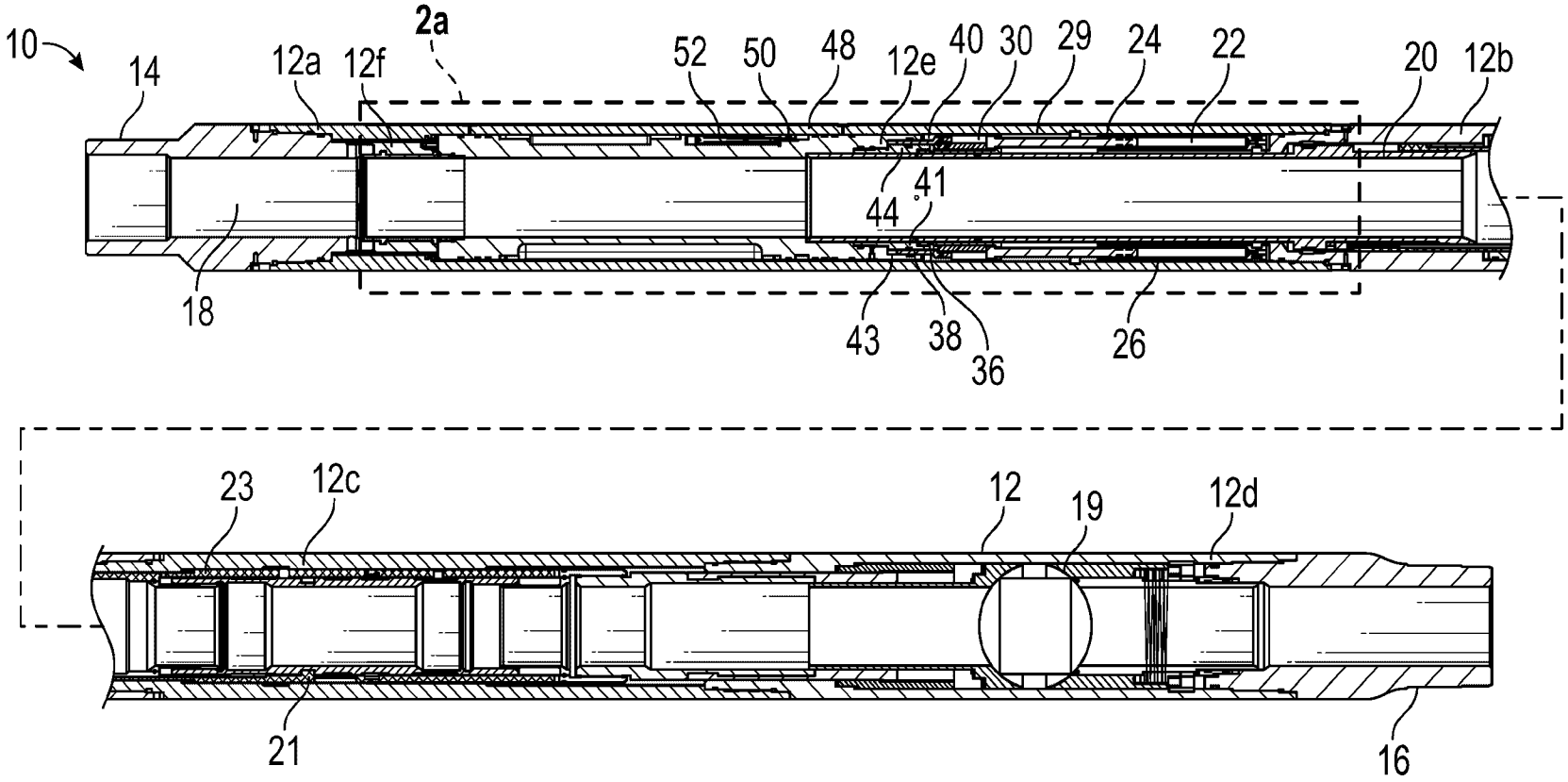
FIG. 1 is a sectional view of a downhole apparatus in an initial configuration.

Reference is first made to FIG. 1 of the drawings, which illustrates a downhole apparatus 10 in accordance with an example of the present disclosure. In this example the apparatus 10 is a downhole valve and is adapted for incorporation in a tubing string (not shown). Accordingly, the apparatus 10 includes a tubular body 12 having an upper threaded box connection 14 and a lower threaded pin connection 16 and defines an axial through bore 18. A valve ball 19 is provided in the bore 18 towards the lower end of the apparatus and may be rotated to permit or prevent passage of fluid through the bore 18. Initially, the ball 19 is positioned to permit flow through the bore 18.

Figure 8:
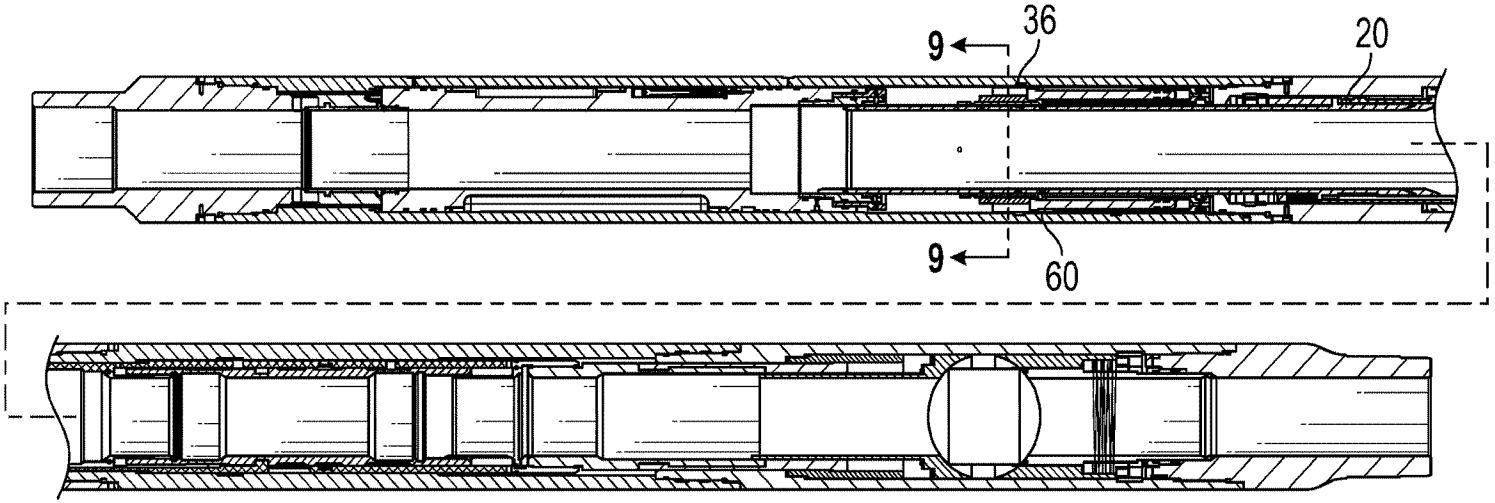

The apparatus 10 includes an upper shifting sleeve 20 which, as will be described, may be translated from a retracted position, as illustrated in FIG. 1, to an extended, active position (as illustrated in FIG. 8). The sleeve 20 is retained in the retracted position until the apparatus 10 has been run into a well to a predetermined depth. As will be described, a signal is then relayed from surface to activate an arrangement of atmospheric chambers 22, allowing associated plunger pistons 24 to be driven through the chambers 22 by the ambient fluid pressure. The pistons 24 are coupled to the shifting sleeve 20 (via piston slider 30 described below) and thus stroke the sleeve 20 to the extended position. The lower end of the sleeve 20 cooperates with linkage arms 21 which in turn cooperate with a lower ball valve shifting sleeve 23. The ball valve shifting sleeve 23 cooperates with spigots on the valve ball 19, such that stroking the sleeve 23 to an extended position rotates the valve ball 19 and closes the bore 18.

Figure 2A:
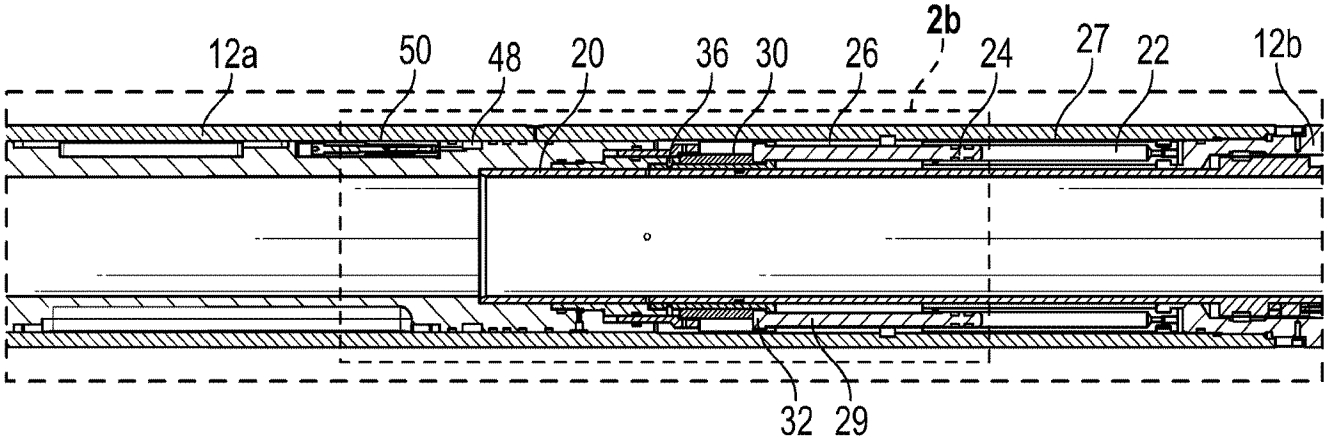
FIGS. 2*a* and 2*b* are enlarged views of area 2*a* of FIG. 1 and area 2*b* of FIG. 2*a;*
Figure 2B:
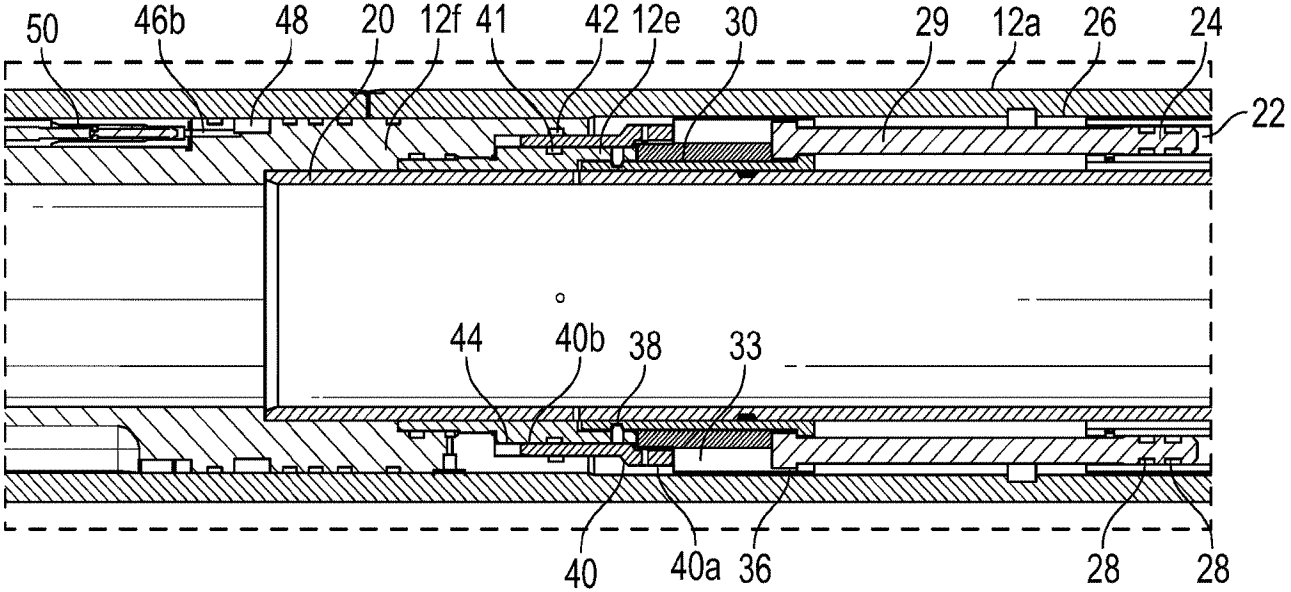
Figure 3:
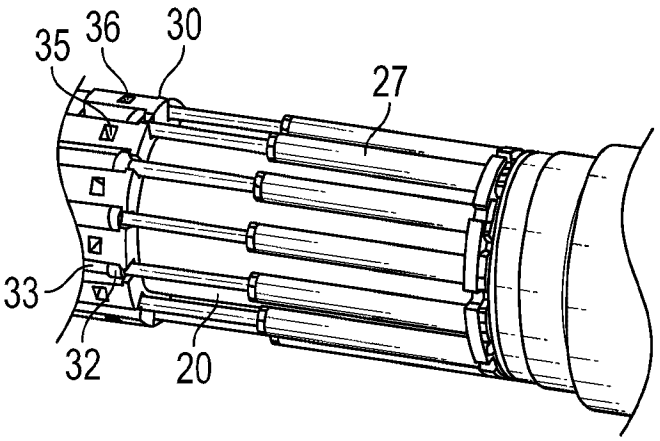
FIG. 3 is an enlarged perspective view of chambers of the apparatus of FIG. 1.

Reference is now also made to FIGS. 2*a*, 2*b* and 3 of the drawings, which illustrate details of the portion of the apparatus 10 featuring the chambers 22 and pistons 24.

The body 12 comprises a number of sections, including four tubular sections 12*a*, 12*b*, 12*c* and 12*d* which are threaded together and provide an outer wall for the body 12. The sleeve 20 is initially located internally of the sections 12*a* and 12*b*, with the chambers 22 being located in an annulus 26 between the body section 12*a* and the sleeve 20. The annulus 26 is in communication with the fluid surrounding the apparatus 10; in use, the fluid in the annulus 26 is thus at the same pressure as the well bore fluid.

The illustrated apparatus features twelve individual chambers 22 spaced equally around the body 12 on a pitch circle diameter (PCD), and extending parallel to the main axis of the body 12. FIG. 3 illustrates the body 12 with the body section 12*a* removed, so that the individual chamber casings 27 are visible; the chamber casings 27 are coupled to the upper end of the adjacent body section 12*b*. The chamber casings 27 are of relatively small diameter (typically less than 1 inch) and are formed of an appropriate material, such as a steel or other alloy, facilitating provision of robust casings which will withstand high external pressures; the casings 27 are only liable to be compromised by collapse pressure.

The pistons 24 are initially positioned towards the upper end of the chambers 22. The apparatus 10 is assembled on surface and the interior volume of the chambers 22 is occupied by atmospheric air. The air is sealed within the chambers 22 by the pistons 24, in this example each piston 24 including two axially-spaced seals 28. The pistons 24 are mounted on rods 29 which extend up through the annulus 26 to a cylindrical piston slider 30, arranged to combine the collective pulling power of the pistons 24. The upper end of each piston rod 29 features a head 32 for engaging the base of a respective axial slot 33 formed in the outer face of the slider 30. A series of twelve circumferentially spaced keys or dogs 36 (FIG. 3) mounted in radially extending keyways 35 couple the slider 30 to the sleeve 20 such that the sleeve 20 will translate with the slider 30.

Figure 4:
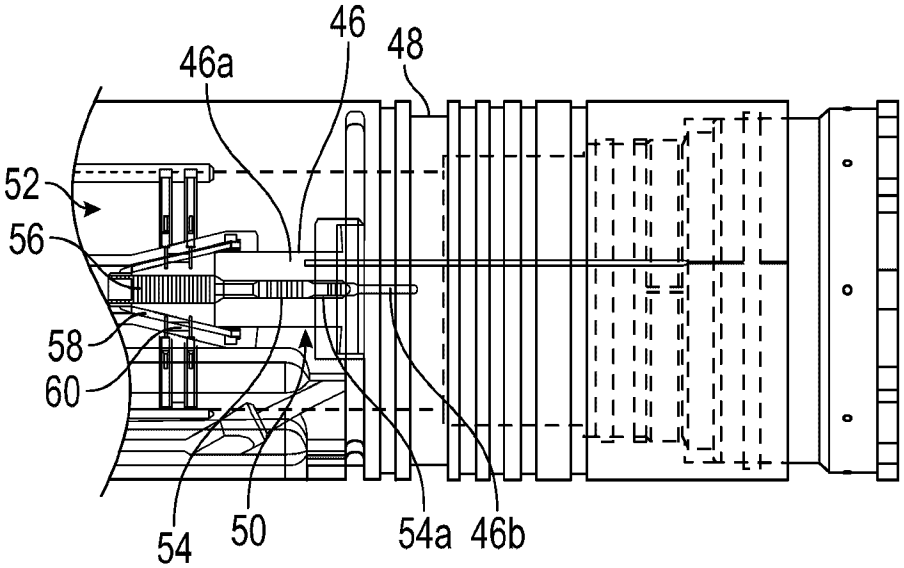
FIG. 4 is an enlarged view showing a fuse mechanism of the apparatus of FIG. 1.

The upper end of the slider 30 is initially restrained relative to a fixed inner body section 12*e* by a further series of eight circumferentially spaced body-mounted keys or dogs 36, with the inner end of each dog 36 engaging a cylindrical groove 38 in the outer surface of the slider 30. The dogs 36 are maintained in engagement with the slider 30 by a lock member in the form of a balance piston 40 with inner and outer seals 41, 42 in sliding sealing contact with the inner body section 12*e* and a further body section 12*f*. The balance piston 40 has a stepped profile, with a lower end of the piston 40*a* defining a larger inner and outer diameter than the upper end 40*b* which engages the seals 41, 42. The body sections 12*e*, 12*f* and the upper end of the piston 40 collectively define a chamber 44 which contains a substantially incompressible control fluid. A communicating passage 46 extends from the chamber 44 to a circumferentially extending atmospheric chamber 48 defined between the body sections 12*a* and 12*f*. However, the passage 46 is initially closed by a valve arrangement 50 which is coupled to a fuse mechanism 52, as illustrated in greater detail in FIG. 4 of the drawings (in which body portion 12*a* has been removed).

The communicating passage 46 includes two parallel portions 46*a*, 46*b*, a feed port and a displacement port, linked by a short transverse portion 46*c*. The passage portions 46*a*, 46*b* are initially isolated from one another by a communication piston 54 which extends into and partially through the passage portion 46*b*. The piston 54 has a smaller diameter leading end portion 54*a* which initially closes the passage 46*b*. Retracting the piston 54 locates the end portion 54*a* in a larger diameter section of the passage 46*b*, permitting fluid communication between the communicating passage portions 46*a*, 46*b*.

A spring 56 in the form of a stack of disc springs urges the piston 54 towards the retracted position, but the piston 54 is initially retrained in the extended, sealing position by loops of KEVLAR cord 58 which extend around the upper end of the piston 54. Coils of nickel chromium wire 60 are located around the KEVLAR cord 58, the coils 60 being coupled, via initially open switches, to batteries capable of providing a flow of current through the coils 60 sufficient to heat the wire and degrade the cord 58, thereby releasing the piston 54 and opening the passage 46. The switches are coupled to a receiver which is capable of detecting activating signals transmitted from surface.

As the apparatus 10 is run into a well the pressure in the internal body annulus 26 will increase and act on the lower part of the balance piston 40, urging the piston 40 upwards into the chamber 44, and urging the plunger pistons 24 downwards into the atmospheric chambers 22. However, the bulk modulus of the control fluid trapped in the chamber 44 will restrict the movement of the piston 40, and the dogs 36 will remain locked in an extended configuration, locking the piston slider 30 to the body 12 and preventing any movement of the pistons 24.

In use, the apparatus 10, in an initial configuration as illustrated in FIGS. 1 and 2, will be incorporated into a tubing string and then run into a fluid-filled well bore. The tubing string will self-fill with fluid, or be top-filled, as the string is made up and advances into the well. As the height of the column of fluid above the apparatus 10 increases, the hydrostatic pressure in the bore 18 and surrounding the apparatus 10 will also increase, as will the pressure of the fluid in the internal body annulus 26. As noted above, this increasing pressure acts on the lower part of the balance piston 40, urging the piston 40 upwards into the chamber 44, and also urges the plunger pistons 24 downwards into the atmospheric chambers 22. However, while the control fluid remains trapped in the chamber 44 and isolated from the atmospheric chamber 48, the dogs 36 remain in the extended configuration and the piston slider 30 remains locked to the body 12.

When the operator decides that the apparatus 10 is to be activated, an appropriate activating signal is generated at surface and transmitted through the fluid in the string to the fuse mechanism 52. The signal is detected by the receiver which then closes the switches between the coils 60 and the battery. The coils 60 will thus heat and quickly degrade the KEVLAR cord 58, allowing the disc springs 56 to retract the piston 54 and open the communicating passage 46.

Figure 5:
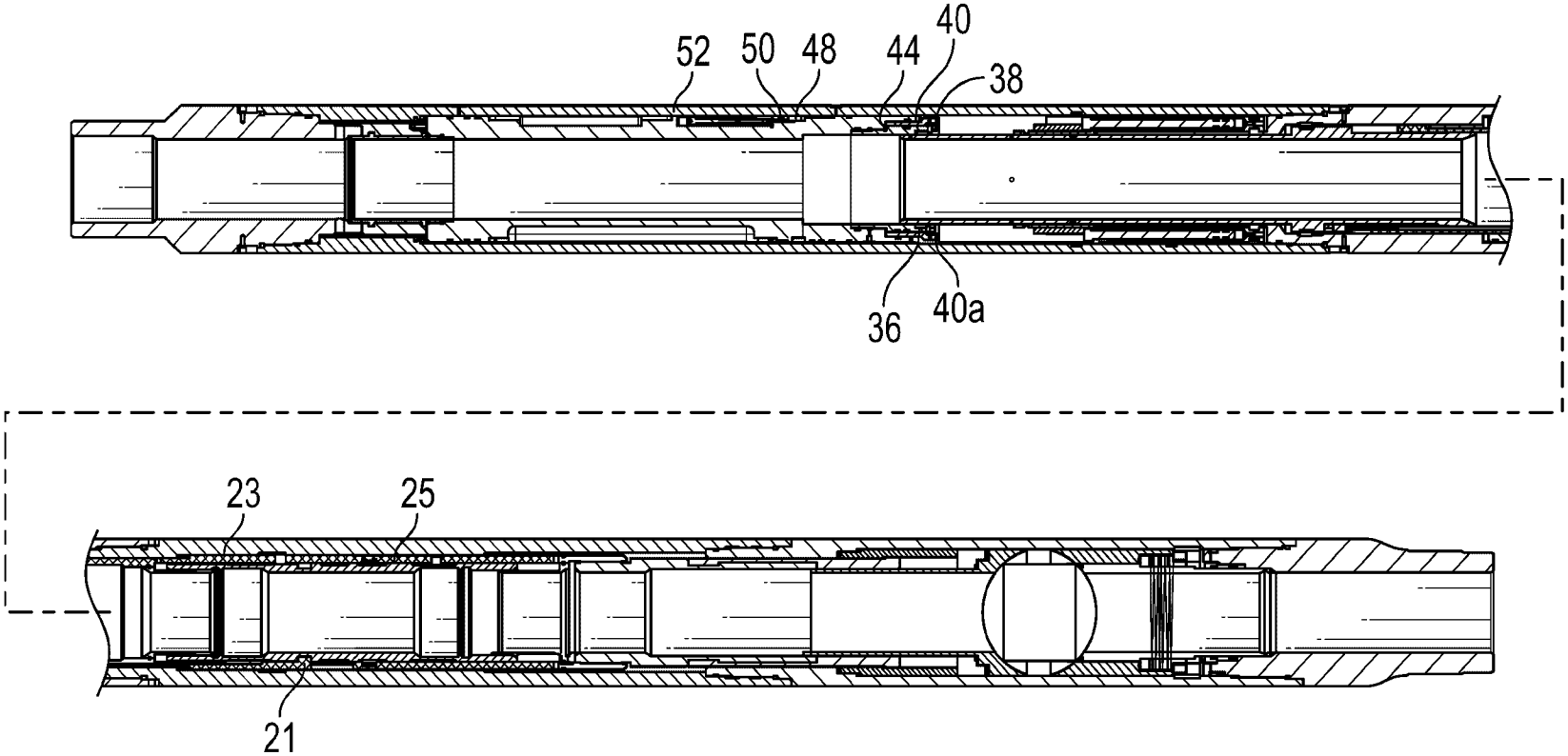
FIGS. 5 to 8 are sectional views of the apparatus of FIG. 1, illustrating stages in an operating sequence of the apparatus.
Figure 6:
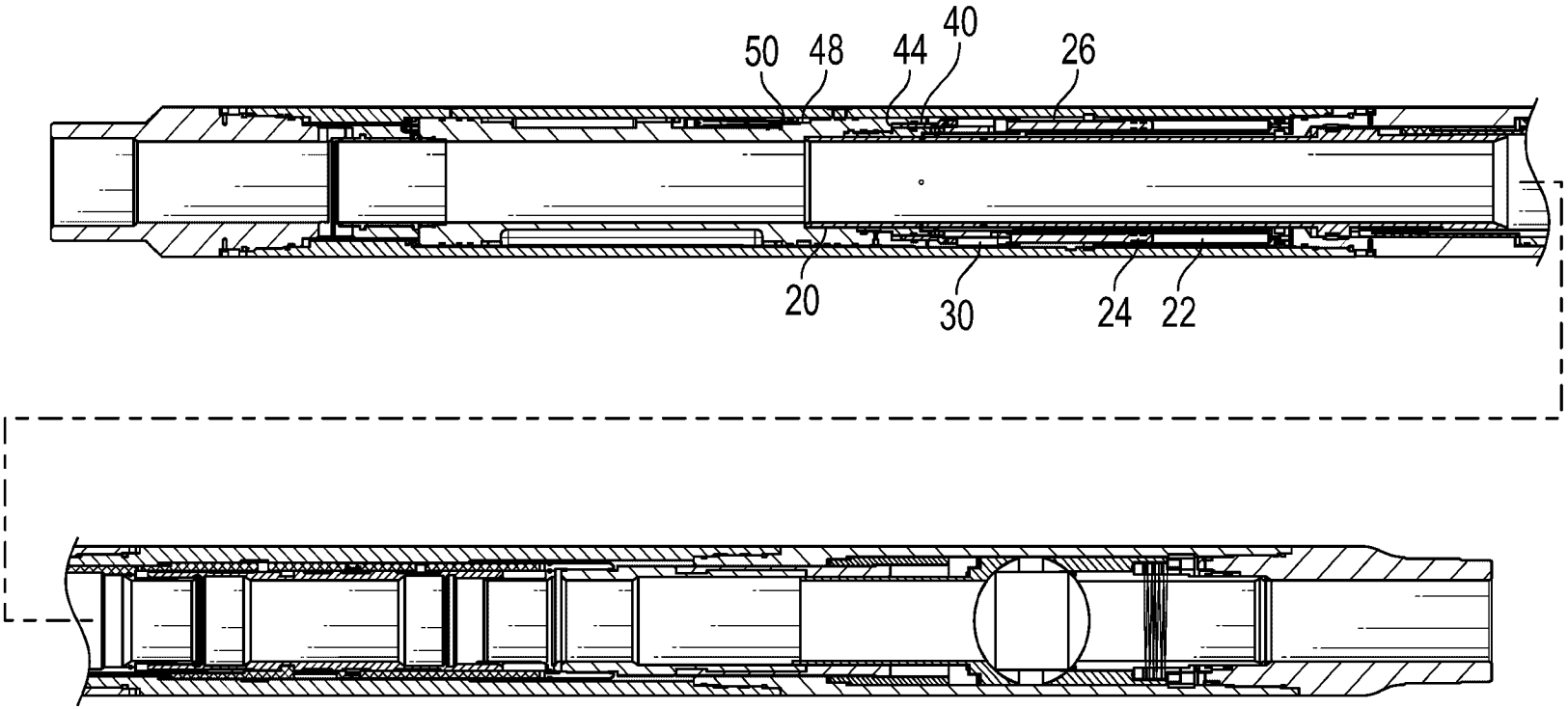
Figure 7:
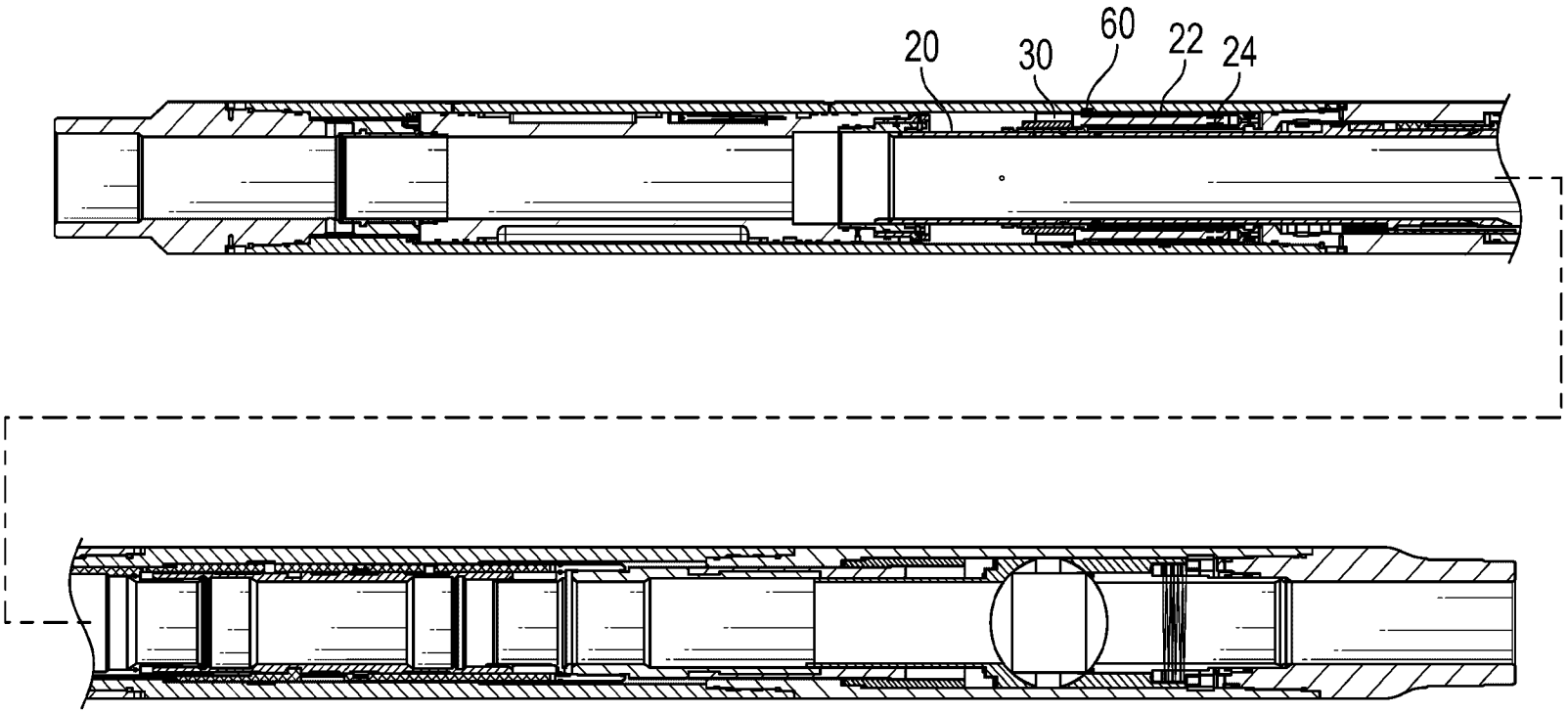

The reconfigured valve arrangement 50 thus now permits fluid communication between the previously isolated chambers 44, 48, such that the compressed fluid in the chamber 44 may be displaced into the air-filled atmospheric chamber 48. This allows the balance piston 40 to translate upwards and occupy the chamber 44, as illustrated in FIG. 5 of the drawings. The larger inner diameter of the lower end of the balance piston 40*a* allows the dogs 36 to rise out of the groove 38, as illustrated in FIG. 6 of the drawings. The piston slider 30 is thus now free to move downwards in response to the high pressure in the annulus 26 urging the pistons 24 into and through the respective atmospheric chambers 22. As the slider 30 remains coupled to the sleeve 20 by the dogs 35 36, movement of the slider 30 also results in corresponding translation of the sleeve 20, as illustrated in FIG. 7 of the drawings.

The stroking of the shifting sleeve 20 provides for corresponding axial translation of the linkage arms 21 and the ball valve shifting sleeve 23. The ball 19 is thus rotated to open the bore 18. Subsequent operation of the valve 10 is achieved by running in a mechanical intervention device to engage with a mechanical shifting sleeve 25: the sleeve 25 is coupled to the ball shifting sleeve 23 and may be moved upwards to open the ball 19, and downwards to close the ball 19.

Figure 9:
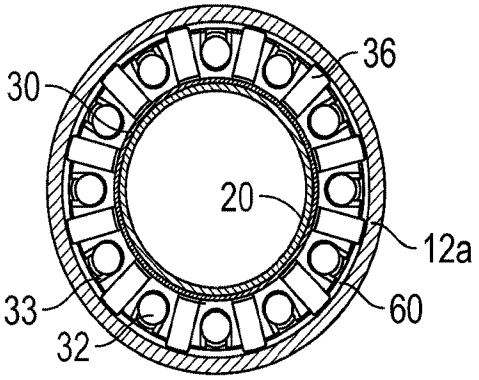
FIG. 9 is a sectional view on line 9-9 of FIG. 8.

On the pistons 24 reaching the end of their stroke through the chambers 22, and the piston slider 30 reaching the end of its stroke, the dogs 36 are located internally of a circumferential groove 60 in the body section 12*a*. This allows the dogs 36 to move outwards and disengage the slider 30 from the sleeve 20, as illustrated in FIGS. 8 and 9 of the drawings.

In the above description it is assumed that all twelve pistons 24 contribute to the stroking of the sleeve 20. However, it may be the case that only a smaller number of pistons is required, and that some pistons 24 and chambers 22 may be omitted.

In the event of the piston seals 28 failing and a chamber 22 filling with well fluid, the associated pistons 24 will not contribute to translating the sleeve 20, but neither will the pistons 24 restrict movement of the slider 30; any non-moving piston heads 32 will simply slide along the respective slots 33. If such free movement was not permitted the failed pistons 24 would be forced to displace the well fluid from the chambers 22 by the action of the operative pistons 24 and the setting force available from the apparatus would be further reduced, potentially preventing the apparatus from functioning.

The chambers 22 may be of any appropriate dimensions. In one example each chamber 22 and piston 24 has a diameter of 0.555 inches, and an area of 0.242 square inches, and thus the twelve pistons 24 provide a total area of 2.903 square inches. If the hydrostatic pressure at the target depth (TD) for the apparatus is 20,000 psi and the force required to move the upper sleeve 20, linkage arms 21, shifting sleeve 23 and ball 19 is 25,000 lbs, only six of the available twelve pistons 24 will be required to generate the required force. The stroke of the pistons 24 may also be selected as appropriate, for example to match the stroke of movement required to rotate the ball through 180 degrees.

The skilled person will of course realize that the number and dimensions of the chambers 22 and pistons 24 may be varied as desired. For example, for use in very deep wells at higher pressures, smaller chambers 22 may be advantageous; the smaller chambers 22 may be more robust, with the higher pressures compensating for the reduction in piston area.

Figure 10:
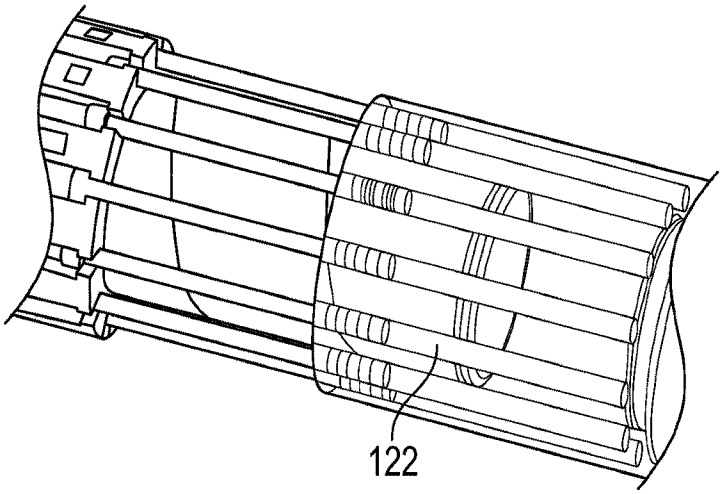
FIG. 10 is a perspective view of chambers of an alternative apparatus (on same sheet as FIG. 3).

The skilled person will further realize that chambers may be formed by other means, for example by cutting a series of cylindrical holes 122 into a single solid piston-housing component, as illustrated in FIG. 10 of the drawings.

The invention claimed is:

1. A downhole apparatus for location in a fluid-filled bore, the apparatus comprising:

a tubular body comprising a plurality of cylindrical chambers for containing a compressible fluid, wherein the chambers initially contain the fluid at atmospheric pressure, pistons mounted in the chambers, wherein the pistons are operatively associated within a common sleeve such that translation of the pistons results in translation of the sleeve, wherein the pistons are coupled to the common sleeve to permit movement of the sleeve without requiring movement of all the pistons; and a lock arrangement having a locking configuration for retaining the pistons in the chambers and having an unlocked configuration in which bore fluid pressure translates the pistons through the chambers.

2. The apparatus of claim 1, wherein the lock arrangement comprises a lock member which is translatable to configure the lock arrangement between the locking configuration and the unlocked configuration to permit movement of the pistons.

3. The apparatus of claim 2, wherein translation of the lock member allows movement of a coupling to permit movement between the pistons and the body.

4. The apparatus of claim 2, wherein the translation of the lock member is in response to the bore fluid pressure.

5. The apparatus of claim 4, wherein lock member comprises a balance piston.

6. The apparatus of claim 4, wherein translation of the lock member requires displacement of a control fluid, wherein displacement of the control fluid is restricted when the lock arrangement is in the locking configuration.

7. The apparatus of claim 6, comprising a valve arrangement to control flow of the control fluid, and movement of the lock member.

8. The apparatus of claim 7, wherein the valve arrangement is operable to permit flow of the control fluid into a lower pressure volume.

9. The apparatus of claim 8, wherein the lower pressure volume comprises an atmospheric chamber.

10. The apparatus of claim 1, wherein the chambers are provided by a plurality of tubes mounted to the body.

11. The apparatus of claim 1, wherein the chambers extend axially of the body and parallel to a main axis of the body.

12. The apparatus of claim 1, wherein the chambers are at least one of circumferentially spaced and axially spaced.

13. The apparatus of claim 1, wherein the lock arrangement comprises a receiver configured to receive a signal to initiate the process of changing the lock arrangement from the locked configuration to the unlocked configuration.

14. A downhole method comprising:

providing a tubular tool body, including pistons associated with a common sleeve and located in cylindrical chambers for containing a compressible fluid, wherein the chambers initially contain the fluid at atmospheric pressure;

running the tool body into a fluid-containing bore such that ambient pressure within the chambers increases, wherein the chambers are in fluid communication with the bore; and translating the pistons through the chambers under the influence of the increased ambient pressure, wherein translation of the pistons results in translation of the sleeve, and wherein the pistons are coupled to the common sleeve to permit movement of the sleeve without requiring movement of all the pistons.

15. The method of claim 14, comprising initially restraining the pistons relative to the body.

16. The method of claim 14, comprising releasing the pistons in response to an activation signal relayed from surface.

17. The method of claim 14, comprising coupling the pistons to a common member and combining forces generated by the pistons.

18. The method of claim 14, comprising translating the pistons to operate a tool or device.

19. The method of claim 14, comprising determining an actuating force required to be provided by the pistons, determining the ambient pressure available in the bore at an operating depth to translate the pistons, and determining the number of chambers and pistons necessary to provide the actuating force.

* * * * *